US008965241B2

(12) United States Patent
Amano

(10) Patent No.: US 8,965,241 B2
(45) Date of Patent: Feb. 24, 2015

(54) DEVELOPMENT DEVICE AND IMAGE FORMING APPARATUS

(71) Applicant: KYOCERA Document Solutions Inc., Osaka (JP)

(72) Inventor: Takeshi Amano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/102,215

(22) Filed: Dec. 10, 2013

(65) Prior Publication Data

US 2014/0161492 A1 Jun. 12, 2014

(30) Foreign Application Priority Data

Dec. 12, 2012 (JP) ..... 2012-270977

(51) Int. Cl.
*G03G 15/08* (2006.01)

(52) U.S. Cl.
CPC ..... *G03G 15/0898* (2013.01)
USPC ..... 399/102; 399/98

(58) Field of Classification Search
CPC ..... G03G 15/0898; G03G 15/08; G03G 15/0806; G03G 15/0808
See application file for complete search history.

(56) References Cited

U.S. PATENT DOCUMENTS

| | | | | |
|---|---|---|---|---|
| 3,570,453 | A * | 3/1971 | Nuzum | 399/234 |
| 4,754,301 | A * | 6/1988 | Kasamura et al. | 399/228 |
| 4,882,605 | A * | 11/1989 | Sakamoto | 399/105 |
| 5,008,708 | A * | 4/1991 | Enoguchi et al. | 399/280 |
| 5,068,691 | A * | 11/1991 | Nishio et al. | 399/284 |
| 6,389,250 | B1 * | 5/2002 | Numagami et al. | 399/111 |
| 6,463,242 | B1 * | 10/2002 | Kojima et al. | 399/258 |
| 7,697,875 | B2 * | 4/2010 | Sakagawa et al. | 399/281 |
| 2007/0086812 | A1 * | 4/2007 | Iio et al. | 399/284 |
| 2009/0047041 | A1 * | 2/2009 | Kubo et al. | 399/222 |
| 2009/0087230 | A1 * | 4/2009 | Hatano | 399/265 |
| 2011/0206419 | A1 * | 8/2011 | Yamamoto | 399/269 |
| 2014/0003845 | A1 * | 1/2014 | Tokudome et al. | 399/284 |
| 2014/0161485 | A1 * | 6/2014 | Ono et al. | 399/111 |

FOREIGN PATENT DOCUMENTS

| | | |
|---|---|---|
| JP | 07-072736 A | 3/1995 |
| JP | 2002-214908 A | 7/2002 |

* cited by examiner

*Primary Examiner* — Clayton E Laballe
*Assistant Examiner* — Ruifeng Pu
(74) *Attorney, Agent, or Firm* — Studebaker & Brackett PC

(57) ABSTRACT

A development device includes a case, a developer carrier, an antiscattering part and a movement mechanism. The case has a supply port supplying developer to an image carrier in which an electrostatic latent image is formed. The developer carrier is rotatably positioned in the case, and develops the electrostatic latent image through the supply port by the developer. The antiscattering part prevents the developer from scattering from the supply port. The movement mechanism makes the developer carrier movable, in the case, between a developing position adjacent to the supply port and a housing position at a depth side from the developing position with respect to the supply port. The antiscattering part is moved, in conjunction with movement of the developer carrier, between an opening position adjacent to the developing position and a withdrawal position far from the opening position, while separating from the developer carrier.

15 Claims, 4 Drawing Sheets

DEVELOPMENT DEVICE AND IMAGE FORMING APPARATUS

INCORPORATION BY REFERENCE

This application is based on and claims the benefit of priority from Japanese Patent application No. 2012-270977 filed on Dec. 12, 2012, the entire contents of which are incorporated herein by reference.

BACKGROUND

The present disclosure relates to a development device including an antiscattering member for developer and an image forming apparatus including the development device.

In an image forming apparatus, such as an electrographic copying machine and a printer, an electrostatic latent image formed on a photosensitive drum is developed with toner (developer) by a developing roller provided in a development device. The development device is provided with an opening in a housing in which the developing roller is installed, and a rotation face of the developing roller is partially exposed outside the development device (a side of the photosensitive drum) through the opening.

The development device may be configured as a CRU (Customer Replaceable Unit) being attachable/detachable (connectable/disconnectable) to/from the image forming apparatus. The development device is provided with a structure in which the developing roller is exposed when the development device is completely attached to the image forming apparatus, while the developing roller is housed inside the housing when the development device is detached from the image forming apparatus. This structure prevents, in the connection and disconnection process of the development device, the developing roller from contacting with the photosensitive drum and protects the developing roller during shipping or storing of the development device.

When the developing roller and photosensitive drum perform rotational movement for developing, co-rotating airflow is generated on the surfaces of the developing roller and photosensitive drum by viscosity of air. Therefore, in particular, in a case where an amount of charge of toner is low due to high-humidity environment or the like, or another case where a magnetic brush receives air resistance, the toner not being contributed to the developing is scattered. Such scatter of the toner results in negative effects such as that an inside of the device is contaminated and the toner is unnecessarily accumulated and moved to the photosensitive drum, thereby causing image defects.

In order to prevent these negative effects, the development device may include a toner antiscattering member. The development device includes, for example, a toner regulating member, which is configured to regulate an amount of the toner carried by the developing roller, in one edge part of the opening in the housing (in an upstream side in a rotational direction of the developing roller), and a toner antiscattering member in another edge part (in a downstream side in the rotational direction of the developing roller). The toner antiscattering member is preferably provided adjacent to the developing roller so as not to scatter toner from the opening to an outside of the development device. The toner antiscattering member is also preferably provided near the above-mentioned other edge part so as to minimize a gap of the opening in order to restrain the scatter of the toner. For example, the toner antiscattering member is suspended from the other edge part or attached to a ceiling or an inside wall positioned at an internal side from the other edge part in the housing.

Further, in another example of the development device, the toner antiscattering member may be provided on an upstream side of the developing roller from a toner regulating blade, a distal end and the periphery to the toner antiscattering member is optionally curved and brought into contact with the developing roller on the tangent line of the developing roller. Therefore, with use of the toner antiscattering member, it is possible to restrain scatter of smoke of the toner generated in thinning a toner layer, without any disturbance in a thin layer of the toner, and to prevent a charge wire in a charger from being contaminated by the toner.

Furthermore, in a further example of the development device, the image forming device adopts a revolving development device and includes a shielding member (the toner antiscattering member) adjacent to the opening of the development device and at the outside thereof. Upper and lower sides of a developing area formed by a developing sleeve and a photosensitive body are enclosed by upper and lower shutters of the shielding member, while a minimal gap is maintained to a surface of the photosensitive body. Therefore, even if a rotation of the developing sleeve and photosensitive body generates airflow in an area enclosed by the shielding member, airflow toward an inside of the development device is generated to collect the toner separated from the developing sleeve to the inside thereof, thereby restraining the scatter of the toner to the outside of the development device.

In the development device provided with the toner antiscattering member as mentioned above, scattered toner may be caught on the toner antiscattering member and accumulated thereon. If the accumulated toner drops inside the development device, a major problem is not caused. However, if the accumulated toner drops outside the development device from the opening, there are some problems that the toner is moved to the photosensitive drum, thereby causing image defects, and the inside of the image forming apparatus is contaminated. In particular, in a case where the toner antiscattering member is provided near the edge part of the opening in the housing, a possibility that the toner accumulated around the toner antiscattering member drops from the opening to the outside of the development device is increased.

In another example of the above mentioned development device, since the toner antiscattering member is brought into contact with the developing roller, there are adverse effects such as that the toner antiscattering member and developing roller are damaged by friction, that products caused by deterioration of the toner antiscattering member or bleeding adheres to the developing roller and that toner is accumulated onto the contact portion. If the toner antiscattering member is fixable, the toner antiscattering member is easily warped or deformed on the basis of changes in usage environments such as temperature and humidity. When this toner antiscattering member comes in contact with the developing roller, such a warp or deformation frequently occurs, and then, it is difficult to obtain proper performances of the toner antiscattering member.

In the further example of the above-mentioned development device, since the toner antiscattering member is attached outside the development device, when the toner accumulated inside the toner antiscattering member drops by oscillation or airflow while the developing roller is driven, the toner is easily moved to the photosensitive drum, thereby causing the image defects. Thus, in a case where the toner antiscattering member is provided outside the development device, in the connection and disconnection process of the development device, there is a possibility that the toner antiscattering member comes into contact with the photosensitive drum.

Furthermore, in a case where the development device is configured to house the developing roller and the toner antiscattering member is provided adjacent to the developing roller, in particular, the toner antiscattering member is provided inside the housing, when the developing roller is housed inside the housing, the developing roller is brought into contact with the toner antiscattering member. In shipping such a development device by a ship or the like, if environment, such as temperature and humidity, is greatly changed in the shipping route, there is a possibility that the products caused by the deterioration of the toner antiscattering member, the bleeding or the like may adhere to the developing roller and that the toner antiscattering member or the developing roller may be damaged by friction, because the developing roller comes into contact with the toner antiscattering member.

In order to prevent the developing roller from being brought into contact with the toner antiscattering member when the developing roller is housed, in a case where the toner antiscattering member is formed in a short shape or a thin shape, an extra forming process becomes necessary in the producing process of the toner antiscattering member. Further, since a gap between the toner antiscattering member and developing roller becomes wider, restrain effects for scattering the toner are impaired.

SUMMARY

In accordance with an embodiment of the present disclosure, a development device includes a case, a developer carrier, an antiscattering part and a movement mechanism. The case has a supply port configured to supply developer to an image carrier in which an electrostatic latent image is formed. The developer carrier is configured to be rotatably positioned in the case, and to develop the electrostatic latent image through the supply port by the developer. The antiscattering part is configured to prevent the developer from scattering from the supply port. The movement mechanism is configured to make the developer carrier movable, in the case, between a developing position adjacent to the supply port and a housing position at a depth side from the developing position with respect to the supply port. The antiscattering part is moved, in conjunction with movement of the developer carrier, between an opening position adjacent to the developing position and a withdrawal position far from the opening position, while separating from the developer carrier.

In accordance with the other embodiment of the present disclosure, an image forming apparatus includes a development device. The development device includes a case, a developer carrier, an antiscattering part and a movement mechanism. The case has a supply port configured to supply developer to an image carrier in which an electrostatic latent image is formed. The developer carrier is configured to be rotatably positioned in the case, and to develop the electrostatic latent image through the supply port by the developer. The antiscattering part is configured to prevent the developer from scattering from the supply port. The movement mechanism is configured to make the developer carrier movable, in the case, between a developing position adjacent to the supply port and a housing position at a depth side from the developing position with respect to the supply port. The antiscattering part is moved, in conjunction with movement of the developer carrier, between an opening position adjacent to the developing position and a withdrawal position far from the opening position, while separating from the developer carrier.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
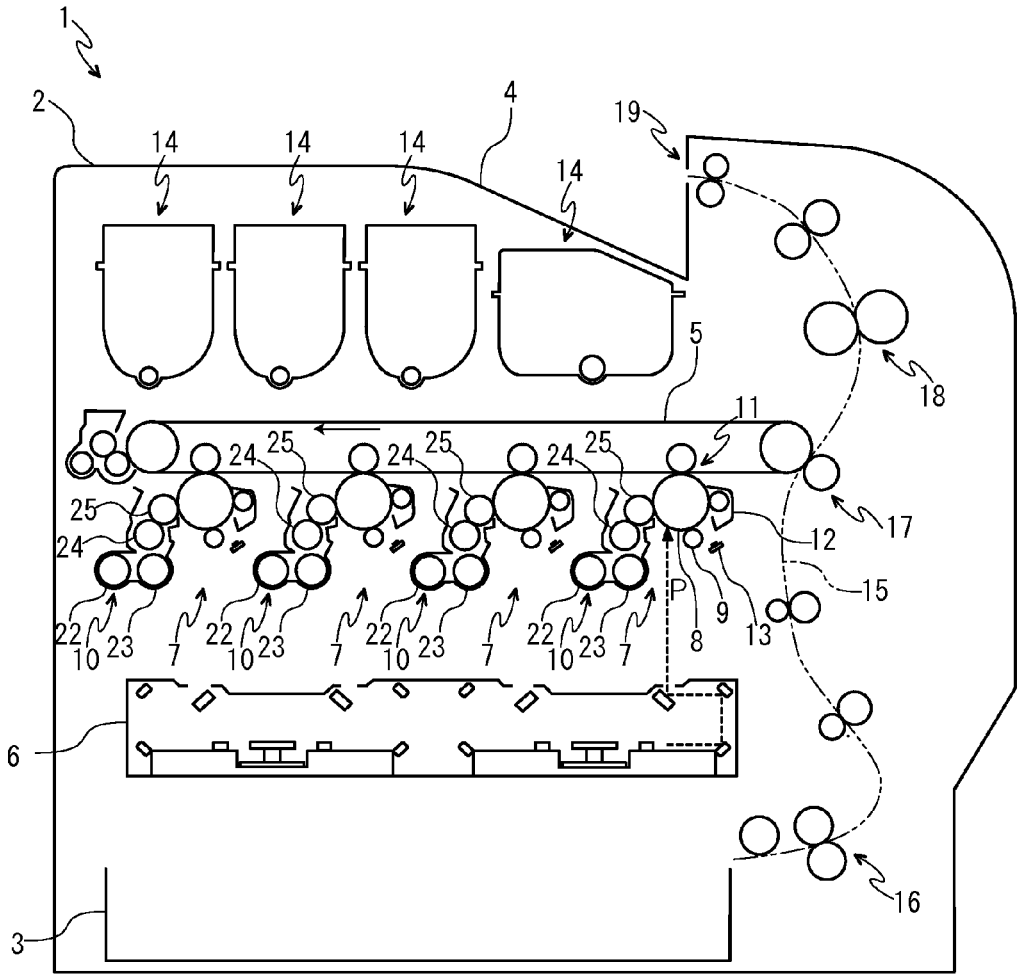
FIG. 1 is a schematic diagram schematically showing an image forming apparatus according to an embodiment of the present disclosure.

First, the entire structure of an image forming apparatus 1 according to the embodiment of the present disclosure will be descried. FIG. 1 is a schematic diagram schematically showing an image forming apparatus according to an embodiment of the present disclosure.

The image forming apparatus 1 is, for example, an electrographic copying machine, a printer (a color printer or laser printer) and the like. As shown in FIG. 1, the image forming apparatus 1 includes a box-formed apparatus main body 2. In a lower part of the apparatus main body 2, a sheet feeding cartridge 3 configured to store transfer sheets (not shown) is installed and, in an upper end of the apparatus main body 2, an ejected sheet tray 4 is installed.

In the upper part of the apparatus main body 2, an intermediate transferring belt 5 as an image carrier is bridged over a plurality of rollers. Below the intermediate transferring belt 5, an exposure device 6 is installed. The exposure device 6 consists of a Laser Scanning Unit (LSU). Along a lower part of the intermediate transferring belt 5, a plurality of image forming units 7 are installed. Each of the image forming units 7 is correspondingly formed for respective colors of, for example, yellow(Y), magenta(M), cyan(C) and black(K). In each image forming unit 7, a photosensitive drum 8 is rotatably attached. Around the photosensitive drum 8, a charger 9, a development device 10, a first transferring unit 11, a cleaning device 12 and a static eliminator 13 are located in a process order of the first transferring. The details of this development device 10 will be described later. Above the intermediate transferring belt 5, a toner conveying device 14 having a toner container (not shown) is correspondingly installed for the respective development devices 10.

At one side (the right-hand side of the figure) in the apparatus main body 2, a sheet conveying path 15 of the transfer sheet is positioned. At an upstream end of the conveying path 15, a sheet feeder 16 is positioned. At an intermediate stream part of the conveying path 15, a second transferring unit 17 is positioned at one end (a right end of the figure) of the intermediate transferring belt 5. In a downstream part of the conveying path 15, a fixing unit 18 is positioned and, in a downstream end of the conveying path 15, an ejection opening 19 is positioned.

Next, the operation of forming an image by the image forming apparatus 1 having such a configuration will be described.

When the power is supplied to the image forming apparatus 1, various parameters are initialized and initial determination, such as temperature determination of the fixing unit 18, is carried out. Subsequently, in the image forming apparatus 1, when image data is inputted and a printing start is directed from a computer or the like connected with the image forming apparatus 1, image forming operation is carried out as follows.

First, the surface of the photosensitive drum 8 is electrically charged by the charger 9. Then, exposure corresponding to the image data is carried out on the photosensitive drum 8 by a laser (refer to an arrow P) from the exposure device 6, thereby forming an electrostatic latent image on the surface of the photosensitive drum 8. The electrostatic latent image is developed to a toner image having a correspondent color with the toner in the development device 10. The toner image is first-transferred onto the surface of the intermediate transferring belt 5 in the first transferring unit 11. The above-mentioned operation is repeated in order by the image forming units 7, thereby forming the toner image having full color onto the intermediate transferring belt 5. Toner and electric charge remained on the photosensitive drum 8 are eliminated by the cleaning device 12 and static eliminator 13.

On the other hand, the transfer sheet fed from the sheet feeding cartridge 3 or a manual bypass tray (not shown) by the sheet feeder 16 is conveyed to the second transferring unit 17 in a suitable timing for the above-mentioned image forming operation. Then, in the second transferring unit 17, the toner image having full color on the intermediate transferring belt 5 is second-transferred onto the transfer sheet. The transfer sheet with the second-transferred toner image is conveyed to a downstream on the conveying path 15 to enter the fixing unit 18, and then, the toner image is fixed on the transfer sheet in the fixing unit 18. The transfer sheet with the fixed toner image is ejected from the ejection opening 19 onto the ejected sheet tray 4.

Figure 2:
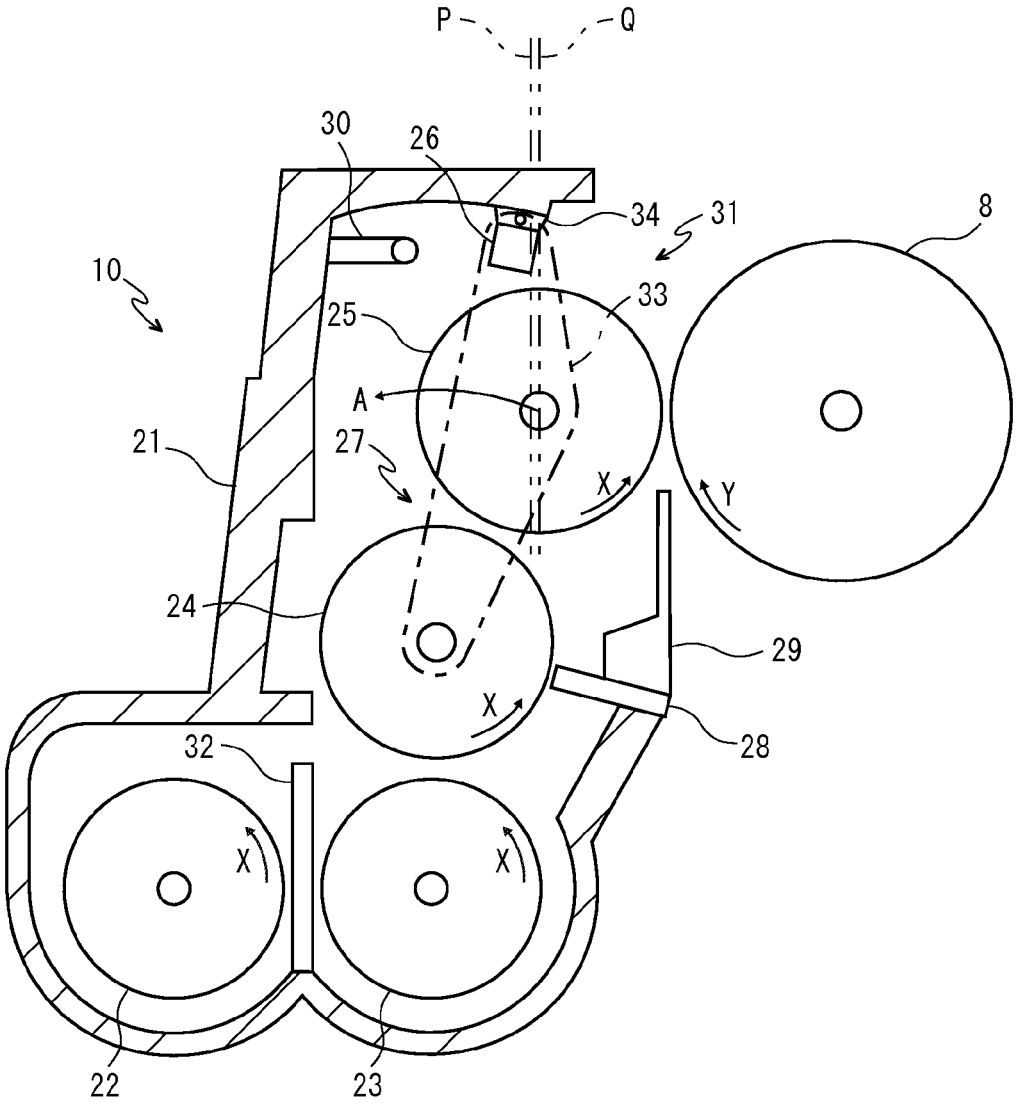
FIG. 2 is a sectional view showing a development device in a situation, in which a developing roller is positioned in a developing position, in the image forming apparatus according to the embodiment of the present disclosure.
Figure 3:
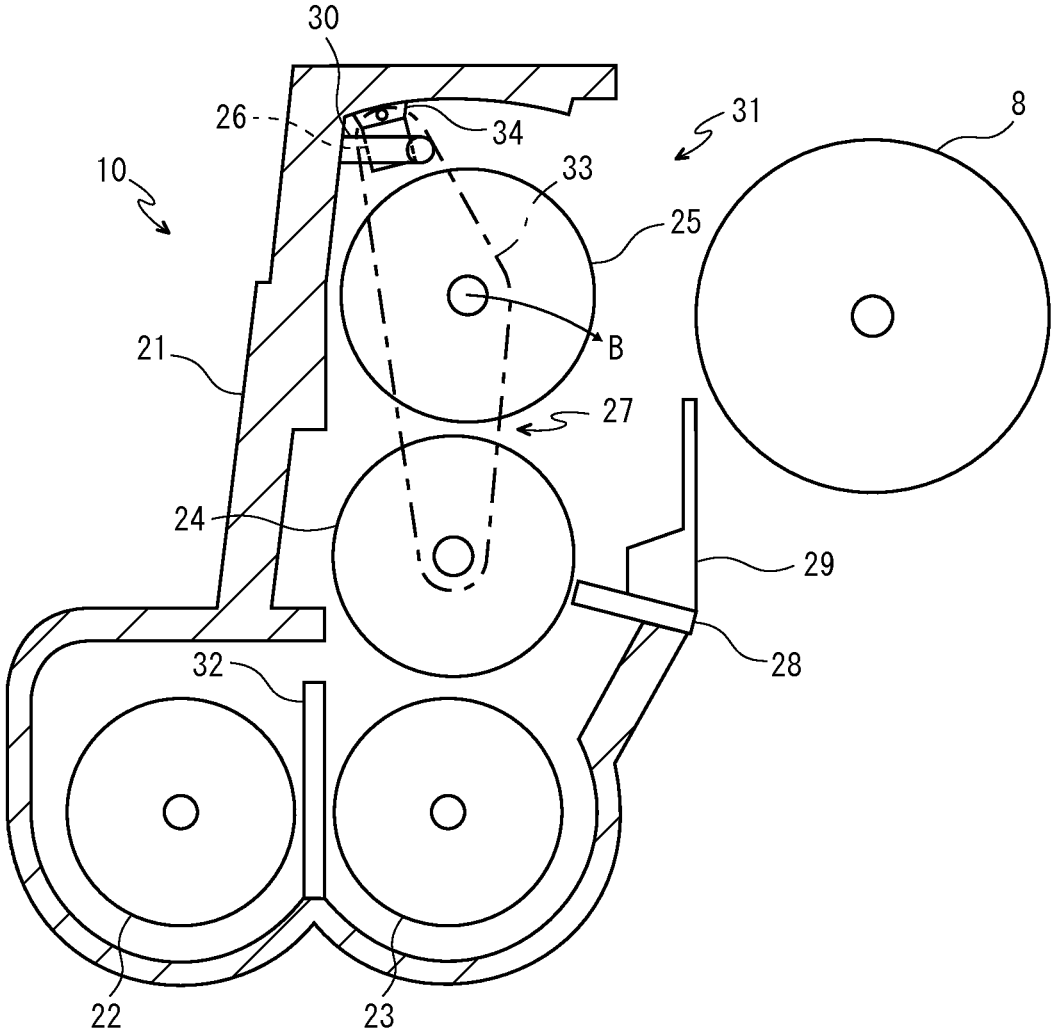
FIG. 3 is a sectional view showing the development device in a situation, in which a developing roller is positioned in a housing position, in the image forming apparatus according to the embodiment of the present disclosure.
Figure 4:
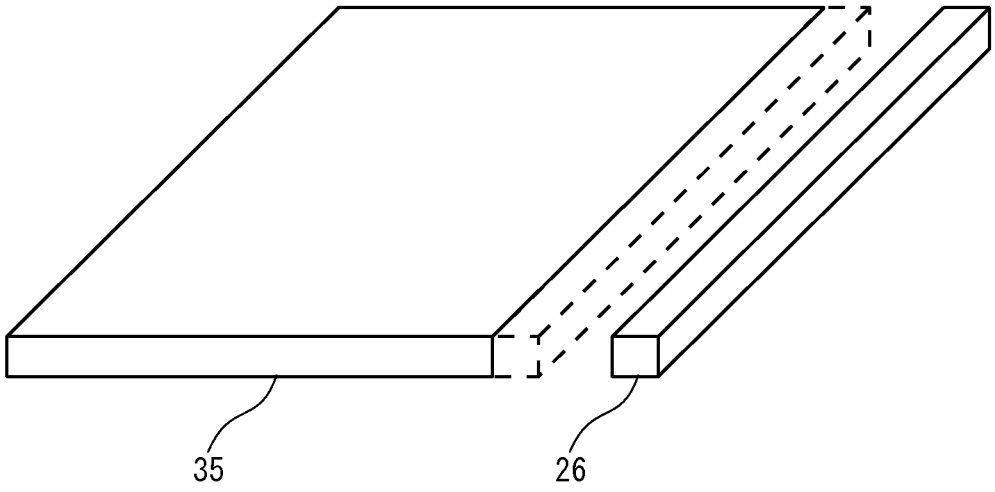
FIG. 4 is a schematic diagram showing a forming example of the toner antiscattering member applied to the development device in the image forming apparatus according to the embodiment of the present disclosure.

Next, the structure of the development device 10 will be described with reference to FIG. 2 to FIG. 4. FIG. 2 is a sectional view showing the development device in a situation, in which a developing roller is positioned in a developing position, in the image forming apparatus according to the embodiment of the present disclosure. FIG. 3 is a sectional view showing the development device in a situation, in which a developing roller is positioned in a housing position, in the development device of the image forming apparatus according to the embodiment of the present disclosure. FIG. 4 is a schematic diagram showing a forming example of the toner antiscattering member applied to the development device of the image forming apparatus according to the embodiment of the present disclosure. For the sake of convenience, in FIG. 2 and FIG. 3, the right-hand side of the figure is assumed as a front side of the development device 10, and the left-hand side of the figure is assumed as a rear side of the development device 10.

The development device 10 is installed to an installed part (not shown) adjacent to the photosensitive drum 8 as an image carrier in the image forming apparatus 1, and connected to the toner conveying device 14 so as to receive toner supply, thereby supplying the toner to the photosensitive drum 8.

The development device 10 includes, in a housing (case) 21, an agitating mixer 22, a paddle mixer 23, a magnetic roller (a developer carrier) 24, a developing roller (a toner carrier) 25 and a toner antiscattering member (an antiscattering part) 26, and moreover, includes a movement mechanism 27 configured to enable the developing roller 25 to move in the housing 21. The development device 10 also includes a developer regulating member 28 adjacent to the magnetic roller 24, a cover 29 adjacent to the developing roller 25 and a protrusion part 30.

The housing 21 is connected to the toner conveying device 14 so as to replenish binary developer consisting of a magnetic carrier and toner. The housing 21 also includes a supply port 31 configured to supply the toner to the photosensitive drum 8 and formed in one side face at a front side of the development device 10. The development device 10 is positioned so that the supply port 31 faces to the photosensitive drum 8.

The agitating mixer 22 and paddle mixer 23 are adjacent to each other via a partition 32 in the housing 21. The agitating mixer 22 and paddle mixer 23 are also a pair of rotating members having rotating shafts being in parallel to each other to be rotatably attached. For example, the agitating mixer 22 and paddle mixer 23 are positioned in parallel in a lower part of the housing 21, and rotate in the same direction (a direction indicated by an arrow X in FIG. 2). The partition 32 is formed shorter than a length of the agitating mixer 22 and paddle mixer 23 in the axis direction, and both ends of the partition are arranged with gaps from an inner face of the housing 21.

The agitating mixer 22 agitates the developer supplied from the toner conveying device 14 by rotation of the agitating mixer 22 to frictionally charge the developer. The agitating mixer 22 also supplies the developer to the paddle mixer 23 through one gap in the partition 32. The paddle mixer 23 agitates and conveys the supplied developer to the magnetic roller 24 by the rotation of the paddle mixer 23. The paddle mixer 23 also agitates the developer returned from the magnetic roller 24 and returns the developer to the agitating mixer 22 through another gap in the partition 32 by the rotation of the paddle mixer 23. That is, the agitating mixer 22 and paddle mixer 23 circulate the developer.

The magnetic roller 24 is arranged adjacent to the paddle mixer 23 with a space between each other. The magnetic roller 24 has also a rotating shaft in parallel to the paddle mixer 23 and is rotatably attached. For example, the magnetic roller 24 is positioned in the middle of the housing 21 above the paddle mixer 23, and rotates in the same direction (the direction indicated by the arrow X in FIG. 2) as the paddle mixer 23.

The magnetic roller 24 is configured to carry the developer on the surface thereof. For example, the magnetic roller 24 has a magnetic body inside to form a magnetic brush of a binary developer consisting of the toner and carrier on the surface by a magnetic line of the magnetic body. The magnetic roller 24 is also configured to convey the toner to the developing roller 25. For example, to the magnetic roller 24, bias voltage is applied uniformly along the axis direction (a longitudinal direction) so as to form electronic field necessary for conveying the toner with the developing roller 25. When the electronic field exceeds electrostatic attachment force between the carrier and toner in the developer, the toner is moved from the developer conveyed near the development roller 25 to the developing roller 25's side along a direction of the electronic field.

The developing roller 25 is arranged adjacent to the magnetic roller 24 with a space between each other, and a rotational face of the developing roller 25 is partially faced to the supply port 31. The developing roller 25 is also configured to have a rotating shaft in parallel to the magnetic roller 24 and is rotatably attached to the movement mechanism 27. For example, the developing roller 25 is positioned in an upper part of the housing 21 above the magnetic roller 24, and rotates in the same direction (the direction indicated by the arrow X in FIG. 2) as the magnetic roller 24. The developing roller 25 is configured to have the rotational face faced to a rotational face of the photosensitive drum 8 through the supply port 31, when the development device 10 is attached to the image forming apparatus 1, so as to rotate in the opposite direction from the photosensitive drum 8.

The developing roller 25 is configured to carry the toner conveyed from the magnetic roller 24. In the developing roller 25, bias voltage is applied uniformly along the axis direction (a longitudinal direction), thereby forming a uniform layer with a predetermined thickness on the surface. The bias voltage of the developing roller 25 has a predetermined potential difference from the bias voltage of the magnetic roller 24, and an amount of the toner conveyed to the developing roller 25 is adjusted by the potential difference. Then, when a toner layer on the surface of the developing roller 25 reaches a predetermined thickness, the amount of the conveyed toner is saturated.

Further, the developing roller 25 is provided movably by the movement mechanism 27 (refer to an arrow A in FIG. 2 and an arrow B in FIG. 3) between a developing position adjacent to the supply port 31 and a housing position at a depth side (a rear side) from the developing position with respect to the supply port 31. In the developing position, the developing roller 25 is positioned to partially expose the rotational face through the supply port 31. The developing roller 25 also supplies the carried toner to the photosensitive drum 8 so as to develop the electrostatic latent image. The bias voltage of the developing roller 25 has a predetermined difference from the bias voltage of the photosensitive drum 8, and the toner is supplied to the photosensitive drum 8 due to the potential difference.

The toner antiscattering member 26 is configured to prevent the toner from scattering from the supply toner 31. The toner antiscattering member 26 has an elongated shape equal to or longer than a length of the developing roller 25 in the axis direction so as to cover the gap of the supply port 31 when the developing roller 25 is positioned in the developing position. The toner antiscattering member 26 is also positioned along the inner face of the housing 21 and adjacent to the developing roller 25. For example, the toner antiscattering member 26 is positioned along a ceiling face of the housing 21 above the developing roller 25 and attached by glue, a double-sided tape or the like.

The toner antiscattering member 26 is formed of soft materials or flexible materials composed of synthetic resin or urethane resin, such as sponge and rubber, so not to damage the other materials by contact. For example, the toner antiscattering member 26 is generated by cutting a plate-like soft material 35 at predetermined intervals, as shown in FIG. 4.

Further, the toner antiscattering member 26 is configured to move in conjunction with movement of the developing roller 25, but to keep a separation (non-contact) from the developing roller 25 regardless of the movement of the developing roller 25. For example, the toner antiscattering member 26 is attached to the movement mechanism 27 above the developing roller 25. The toner antiscattering member 26 is also provided rotatably by the movement mechanism 27 between an opening position and a withdrawal position. The opening position is adjacent to a developing position of the developing roller 25 and an opening of the supply port 31, and the withdrawal position is positioned at the depth side (the rear side) far from the opening position with respect to the supply port 31. Then, the toner antiscattering member 26 is moved along the ceiling face of the housing 21 in the same direction as the developing roller 25.

In particular, in the present embodiment, when the developing roller 25 is positioned in a developing position, the toner antiscattering member 26 is positioned, in forward and backward directions of the development device 10, at the opening position in the housing 21 at an opposite side (a rear side) from the supply port 31 across a rotating shaft line of the developing roller 25. For example, the toner antiscattering member 26 is arranged so that a vertical line P passing through an end part at the developing roller 25's side of the toner antiscattering member 26, in particular, passing through an edge part at the photosensitive drum 8's side (a front side) of the toner antiscattering member 26, is positioned in an opposite side (a rear side) from the supply port 31 across a vertical line Q passing through a center of the developing roller 25 in the forward and backward directions.

The movement mechanism 27 is provided along the inner face or an outer face of the housing 21 at both ends of the developing roller 25 in the axis direction. The movement mechanism 27 is configured to move the development roller 25 between the developing position and the housing position in conjunction with attachment and detachment of the development device 10 with respect to the installed part of the image forming apparatus 1, and then, to stop the development roller 25 in an engaged state in either position. For example, the movement mechanism 27 is provided with a pair of plate-like supporting parts 33 extending from the magnetic roller 24 to the toner antiscattering member 26, and one ends of respective supporting parts 33 are attached to both ends of the rotating shaft of the magnetic roller 24, whereby the movement mechanism 27 is configured to be rotatable separately from the magnetic roller 24. Near a center of each supporting part 33, an end of a rotating shaft of the developing roller 25 is attached and, to another end of each supporting part 33, an end of the toner antiscattering member 26 is attached. The movement mechanism 27 is also provided with an attachment part 34 extending to a longitudinal direction of the toner antiscattering member 26 along the ceiling face of the housing 21 so as to fix the attachment part 34 at the other end of the supporting part 33. The toner antiscattering member 26 is attached onto the attachment part 34.

The movement mechanism 27 may be provided with a biasing member, such as a spring. By connecting the biasing member to the supporting parts 33, the movement mechanism 27 may be configured to maintain the developing roller 25 in the housing position or the developing position by biasing force, and to maintain the developing roller 25 in the developing position or the housing position by releasing the biasing force.

As mentioned above, the movement mechanism 27 is configured to freely rotate the developing roller 25 and toner antiscattering member 26 centering around a rotating shaft of the magnetic roller 24. That is, the movement mechanism 27 is configured not to change a triangular positional relationship formed by a rotational center of the magnetic roller 24, a rotational center of the developing roller 25 and an attachment position of the toner antiscattering member 26 regardless of movement of the developing roller 25.

The attachment part 34 is configured to smoothly slide without any gap along the ceiling face of the housing 21. For example, it is preferable to form the ceiling face of the housing 21 by a curving face (an arc-like depression centering around the rotating shaft of the magnetic roller 24) parallel to a rotational orbit of the developing roller 25. In addition, it is preferable to form a face of the attachment part 34 contacting with the ceiling face by materials having good slidability, such as a low friction coefficient, so as to become a curving face suitable to the ceiling face.

The developer regulating member 28 extends from the vicinity of an edge of the housing 21 forming the supply port 31 to the magnetic roller 24, and is attached to the development device 10 with a predetermined gap from the magnetic roller 24, for example, a gap of about 0.20 mm to 0.35 mm. The developer regulating member 28 may be a plate-like material having an elongated shape equal to or longer than a length of the magnetic roller 24 in the axis direction. The developer regulating member 28 regulates a height of the magnetic brush formed on the magnetic roller 24 and adjusts an amount of the developer passing through the gap by regulating a gap with the magnetic roller 24, thereby regulating the developer conveyed to the developing roller 25 in a downstream side of the magnetic roller 24 to a predetermined amount.

The cover 29 is provided to extend from the developer regulating member 28 to the developing roller 25 near the edge of the housing 21 forming the supply port 31. The cover 29 prevents the toner, which is conveyed from the magnetic roller 24 to the developing roller 25, from leaking from the supply port 31 to the outside. For example, one end of the cover 29 is positioned to be adjacent to a gap between the developing roller 25 and photosensitive drum 8.

The protrusion part 30 is formed in an elongated shape equal to or longer than a length of the toner antiscattering member 26. In the forward and backward directions of the development device 10, the protrusion part 30 is attached to another side face of the housing 21 at an opposite side (a rear side) from the supply port 31 so as to be in parallel with the toner antiscattering member 26 and to protrude to the toner antiscattering member 26's side. The protrusion part 30 lightly comes into contact with the toner antiscattering member 26 when the toner antiscattering member 26 is moved to the withdrawal position, to give light impulsions, such as flipping, flicking and scratching, to the toner antiscattering member 26. For example, the protrusion part 30 may be configured to be formed in an elongated shape having an L-shaped cross-section so as to receive the toner antiscattering member 26 or configured to separate an elongated part having rod-like or net-like shape from the other side face as mentioned above. However, the protrusion part 30 is not restricted by these shapes, the protrusion part 30 may be formed in a shape giving the light impulsions to the toner antiscattering member 26.

Next, movement operations of the developing roller in the development device 10 will be described in detail.

First, in a case where the development device 10 is not installed to the image forming apparatus 1 in shipping or in storing, the development device 10 uses the movement mechanism 27 to maintain the developing roller 25 in the housing position and to maintain the toner antiscattering member 26 in the withdrawal position at the depth side the rotating shaft line of the developing roller 25 in the housing 21 so as to separate the toner antiscattering member 26 from the developing roller 25.

Subsequently, when the development device 10 is installed to the image forming apparatus 1, the movement mechanism 27 rotates to the supply port 31's side centering around the rotating shaft of the magnetic roller 24. At that moment, the developing roller 25 and toner antiscattering member 26 attached to the movement mechanism 27 turn centering around the rotating shaft of the magnetic roller 24, while maintaining being separated from each other. Then, the developing roller 25 and toner antiscattering member 26 are moved until the developing roller 25 is positioned in the developing position, and the toner antiscattering member 26 is maintained in the opening position.

Because the developing roller 25, which is positioned in the developing position as mentioned above, is positioned at an upstream side in toner conveyance by the magnetic roller 25, the developing roller 25 effectively receives and carries the toner supplied from the magnetic roller 24. In addition, because the developing roller 25 is adjacent to the photosensitive drum 8 via the supply port 31, the developing roller 25 develops the electrostatic latent image on the photosensitive drum 8 by the carried toner.

Because the toner antiscattering member 26 is adjacent to the developing roller 25, the toner antiscattering member 26 surely prevents the toner scattered inside the housing 21 from leaking to the outside through the tonner supply 31. Because the toner antiscattering member 26 is positioned at the depth side from the rotating shaft line of the developing roller 25 in the housing 21, even if the toner adheres and is accumulated onto the toner antiscattering member 26 and the toner thereafter drops, the toner is moved to the depth side from the developing roller 25 in the housing 21.

Further, when the development device 10 after use is detached from the image forming apparatus 1, the movement mechanism 27 turns to the depth side centering around the rotating shaft of the magnetic roller 24 in the housing 21. At that moment, the developing roller 25 and toner antiscattering member 26 attached to the movement mechanism 27 turn centering around the rotating shaft of the magnetic roller 24, while maintaining being separated from each other. Then, the developing roller 25 is moved until the developing roller 25 is positioned in the housing position, and the toner antiscattering member 26 is maintained in the withdrawal position. When the toner antiscattering member 26 is moved to the withdrawal position, before the developing roller 25 stops at the housing position, the toner antiscattering member 26 receives impulsion by lightly contacting with the protrusion part 30, thereby removing the adhered toner and refreshing the toner antiscattering member 26.

According to the present embodiment, by adopting the above-mentioned structure, when the developing roller 25 is housed at the depth side in the housing 21, because the toner antiscattering member 26 does not come into contact with the developing roller 25, it is possible to eliminate adverse effects to the developing roller 25 caused by the toner antiscattering member 26, and furthermore, to effectively restrain scatter of the toner.

As mentioned above, in the present embodiment, since the toner antiscattering member 26 is positioned opposite from the supply port 31 across the rotating shaft line of the developing roller 25, even if the toner accumulated onto the toner antiscattering member 26 drops, the toner is moved to the depth side from the developing roller 25 in the housing 21 and re-entered in the housing 21. Therefore, the toner accumulated onto the toner antiscattering member 26 does not cause damage in the photosensitive drum 8, contamination inside the image forming apparatus 1, and defects in an image to be developed.

Further, according to the present embodiment, the movement mechanism 27 moves, in conjunction with the movement of the developing roller 25 from the developing position to the housing position, the toner antiscattering member 26 from the opening position to the withdrawal position at the depth side in the housing 21, while maintaining a separation distance between the developing roller 25 and toner antiscattering member 26. Therefore, since the developing roller 25 maintains the separation distance with the toner antiscattering member 26, it is possible to surely prevent the developing roller 25 from moving to come into contact with the toner antiscattering member 26, thereby eliminating adverse effects to the developing roller 25 caused by the toner antiscattering member 26.

Further, according to the present embodiment, it is preferable that the toner antiscattering member 26 is attached to the movement mechanism 27 along the ceiling face of the housing 21 in an upper side of the developing roller 25, and that the movement mechanism 27 moves the toner antiscattering member 26 along the ceiling face. Therefore, it is possible to eliminate a gap leaking the toner from the supply port 31 to the outside, and to prevent the toner from accumulating on the ceiling face of the housing 21.

Further, according to the present embodiment, in a lower side of the developing roller 25 inside the housing 21, a turning shaft is provided in parallel with a rotating shaft line of the developing roller 25. The movement mechanism 27 is provided at both ends of the turning shaft in an axis direction to extend from the turning shaft to the toner antiscattering member 26 through the developing roller 25, and also provided with a pair of the supporting parts 33 configured to be rotatable around the turning shaft. Then, in accordance with turns of a pair of the supporting parts 33, the movement mechanism 27 moves the toner antiscattering member 26 to the opening position when the developing roller 25 is moved to the developing position, and moves the toner antiscattering member 26 to the withdrawal position when developing roller 25 is moved to the housing position. Therefore, it is possible to realize both movement of the magnetic roller 24, and separation between the magnetic roller 24 and toner antiscattering member 26 by a simple structure.

For example, since the triangular positional relationship formed by the rotational center of the magnetic roller 24, the rotational center of the developing roller 25 and the attachment position of the toner antiscattering member 26 does not change regardless of the movement of the developing roller 25, the developing roller 25 can be moved to the developing position or the housing position with no direct contact with the toner antiscattering member 26 (with maintaining separation), thereby preventing any damage of the developing roller 25 caused by the contact. Further, since the developing roller 25 is configured to be positioned in the housing position without the contact with the toner antiscattering member 26, it is possible to prevent any damage or deterioration caused by the contact with the toner antiscattering member 26 during shipping or storing of the development device 10.

Accordingly, it is not necessary to carry out special process to the toner antiscattering member 26 for the purpose of preventing the contact (preventing the damage) with the developing roller 25, thereby reducing an amount of man-hour and cost of the process of the toner antiscattering member 26 without failing to obtain toner antiscattering effects.

Further, according to the present embodiment, the magnetic roller 24 forming the toner layer on a surface of the developer carrier is provided, and the turning shaft of the movement mechanism 27 is the rotating shaft of the magnetic roller 24. Therefore, the movement mechanism 27 of the magnetic roller 24 can be configured by effectively using parts already provided in the development device 10.

Further, according to the present embodiment, the housing 21 is provided with the protrusion part 30 protruding to the developing roller 25's side inside a side face opposite from the supply port 31 across the developing roller 25. The toner antiscattering member 26 comes into contact with the protrusion part 30 when moving from the opening position to the withdrawal position. Therefore, when the toner antiscattering member 26 lightly receives impulsions by contacting with the protrusion part 30, it is possible to eliminate the toner adhered to the antiscattering member 26 and to refresh the antiscattering member 26.

A structure of the development device 10 is not limited to the embodiments described above. For example, the development device 10 may include a supply port cover for opening and closing the supply port 31 in conjunction with attachment and detachment to/from the image forming apparatus 1. The development device 10 may be configured so that the movement mechanism 27 works in conjunction with opening and closing of the supply port 31. That is, in detachment of the development device 10, the supply port cover closes the supply port 31, and the movement mechanism 27 moves the developing roller 25 to the housing position in conjunction with this. On the other hand, in attachment of the development device 10, the supply port cover opens the supply port 31, and the movement mechanism moves the developing roller 25 to the developing position in conjunction with this.

Further, a structure moving the developing roller 25 in conjunction with attachment and detachment of the development device 10 is not limited to the embodiments described above. For example, another structure may be configured so that the movement mechanism 27 includes an engaging projection, such as a hook and a pin, protruding from the supporting parts 33 to an outside of the housing 21, and the installed part of the image forming apparatus includes an engaging depression guiding the engaging projection. That is, before the development device 10 is installed, the movement mechanism 27 maintains the developing roller 25 in the housing position. Then, when the development device 10 is installed, the engaging projection and engaging depression are engaged with each other, and the supporting parts 33 is turned in conjunction with this engagement so as to move the developing roller 25 to the developing position. Alternatively, the movement mechanism 27 may include the engaging depression, and the installed part may include the engaging projection.

The present embodiment was described so that the movement mechanism 27 is provided with the supporting parts 33 extending from the magnetic roller 24 to the antiscattering member 26. However, in another embodiment, the movement mechanism 27 may be configured to include a supporting part extending from the developing roller 25 to the antiscattering member 26 in place of the supporting parts 33. In such a case, a guiding gap or the like extending from the developing position to the housing position is provided at a side face of the housing 21, and the supporting part is attached to the guide gap, thereby making the developing roller 25 and antiscattering member movable between the developing position and housing position.

The present embodiment was described so that the movement mechanism 27 is configured to move the antiscattering member 26 to the depth side in the housing 21 when moving the developing roller 25 to the housing position. However, in another embodiment, the movement mechanism 27 may be configured to move the antiscattering member 26 to the outside of the housing 21 while separating the antiscattering member 26 from the developing roller 25, when moving the developing roller 25 to the housing position.

The present embodiment was described about the image forming apparatus 1 as a touchdown system that the development device 10 uses binary developer consisting of the magnetic carrier and toner, and the development device 10 includes the magnetic roller 24. However, in another embodiment, the image forming apparatus 1 may be configured to use a single-component developer (toner), and the development device 10 may be configured not to include the magnetic roller 24.

In the present embodiment, an electrographic copying machine and a printer are cited as an example of an image forming apparatus. However, in other embodiments, the configuration of the disclosure may be applied to another image forming apparatus, such as a copying machine, facsimile, and a digital multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A development device comprising:

a case having a supply port configured to supply developer to an image carrier in which an electrostatic latent image is formed;

a developer carrier configured to be rotatably positioned in the case, and to develop the electrostatic latent image through the supply port by the developer;

an antiscattering part configured to prevent the developer from scattering from the supply port; and a movement mechanism configured to make the developer carrier movable, in the case, between a developing position adjacent to the supply port and a housing position at a depth side from the developing position with respect to the supply port, wherein the antiscattering part is moved, in conjunction with movement of the developer carrier, between an opening position adjacent to the developing position and a withdrawal position far from the opening position, while separating from the developer carrier.

2. The development device according to claim 1, wherein the antiscattering part is configured to be adjacent to the developer carrier in an opposite side from the supply port across a rotating shaft line of the developer carrier when being positioned at the opening position.

3. The development device according to claim 1, wherein the movement mechanism moves, in conjunction with movement of the developer carrier from the developing position to the housing position, the antiscattering part from the opening position to the withdrawal position at the depth side in the case, while maintaining a separation distance between the developer carrier and antiscattering part.

4. The development device according to claim 3, wherein the antiscattering part is attached to the movement mechanism along a ceiling face of the case in an upper side of the developer carrier, and the movement mechanism moves the antiscattering part along the ceiling face.

5. The development device according to claim 3 further comprising:

a turning shaft configured to be in parallel with a rotating shaft line of the carrier developer in a lower side of the carrier developer inside the case, wherein the movement mechanism is configured to extend from the turning shaft to the antiscattering part through the carrier developer at both sides of the turning shaft in an axis direction, and to include a pair of supporting parts rotatable around the turning shaft, and in accordance with turns of a pair of the supporting parts, the antiscattering part is moved to the opening position when the developer carrier is moved to the developing position, and the antiscattering part is moved to the withdrawal position when the developer carrier is moved to the housing position.

6. The development device according to claim 5, further comprising:

a magnetic roller configured to form a layer of the developer on a surface of the developer carrier, wherein the turning shaft is a rotating shaft of the magnetic roller.

7. The development device according to claim 3, wherein the case is provided with a protrusion part configured to protrude to the developer carrier side inside a side face opposite from the supply port across the developer carrier, and the antiscattering part is configured to come into contact with the protrusion part when moving from the opening position to the withdrawal position.

8. An image forming apparatus comprising:

a development device including:

the development device including:

a case having a supply port configured to supply developer to an image carrier in which an electrostatic latent image is formed;

a developer carrier configured to be rotatably positioned in the case, and to develop the electrostatic latent image through the supply port by the developer;

an antiscattering part configured to prevent the developer from scattering from the supply port; and a movement mechanism configured to make the developer carrier movable, in the case, between a developing position adjacent to the supply port and a housing position at a depth side from the developing position with respect to the supply port, wherein the antiscattering part is moved, in conjunction with movement of the developer carrier, between an opening position adjacent to the developing position and a withdrawal position far from the opening position, while separating from the developer carrier.

9. The image forming apparatus according to claim 8, wherein the antiscattering part is configured to be adjacent to the developer carrier in an opposite side from the supply port across a rotating shaft line of the developer carrier when being positioned at the opening position.

10. The image forming apparatus according to claim 8, wherein the movement mechanism moves, in conjunction with movement of the developer carrier from the developing position to the housing position, the antiscattering part from the opening position to the withdrawal position at the depth side in the case, while maintaining a separation distance between the developer carrier and antiscattering part.

11. The image forming apparatus according to claim 10, wherein the antiscattering part is attached to the movement mechanism along a ceiling face of the case in an upper side of the developer carrier, and the movement mechanism moves the antiscattering part along the ceiling face.

12. The image forming apparatus according to claim 10, wherein the development device further includes a turning shaft configured to be in parallel with a rotating shaft line of the carrier developer in a lower side of the carrier developer inside the case, wherein the movement mechanism is configured to extend from the turning shaft to the antiscattering part through the carrier developer at both sides of the turning shaft in an axis direction, and to include a pair of supporting parts rotatable around the turning shaft, and in accordance with turns of a pair of the supporting parts, the antiscattering part is moved to the opening position when the developer carrier is moved to the developing position, and the antiscattering part is moved to the withdrawal position when the developer carrier is moved to the housing position.

13. The image forming apparatus according to claim 12, wherein the development device further includes a magnetic roller configured to form a layer of the developer on a surface of the developer carrier, wherein the turning shaft is a rotating shaft of the magnetic roller.

14. The image forming apparatus according to claim 10, wherein the case is provided with a protrusion part configured to protrude to the developer carrier side inside a side face opposite from the supply port across the developer carrier, and the antiscattering part is configured to come into contact with the protrusion part when moving from the opening position to the withdrawal position.

15. The image forming apparatus according to claim 8, wherein the movement mechanism moves the developer carrier to the developing position when the development device is attached, and the movement mechanism moves the developer carrier to the housing position when the development device is detached.

* * * * *